US009089006B2

(12) United States Patent
Cho et al.

(10) Patent No.: US 9,089,006 B2
(45) Date of Patent: Jul. 21, 2015

(54) INTELLIGENT HEATER AND TEMPERATURE MEASURING DEVICE

(75) Inventors: Cheng-Hsien Cho, Taoyuan Hsien (TW); Yin-Yuan Chen, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 989 days.

(21) Appl. No.: 12/941,203

(22) Filed: Nov. 8, 2010

(65) Prior Publication Data

US 2011/0108546 A1 May 12, 2011

(30) Foreign Application Priority Data

Nov. 9, 2009 (TW) ..... 98137986 A

(51) Int. Cl.
*H05B 6/12* (2006.01)
*H05B 6/06* (2006.01)

(52) U.S. Cl.
CPC ..... *H05B 6/062* (2013.01)

(58) Field of Classification Search
CPC .. H05B 6/1209; H05B 6/062; H05B 2213/05; H05B 2213/07; H05B 2213/06; H05B 3/746
USPC ..... 219/600, 620, 621, 622, 624, 627, 209, 219/660, 666, 675, 710, 712, 713, 714, 720, 219/441, 448.11, 506, 391, 445.1; 99/DIG. 14
See application file for complete search history.

(56) References Cited

U.S. PATENT DOCUMENTS

| | | | | |
|---|---|---|---|---|
| 3,742,175 | A * | 6/1973 | Harnden, Jr. | 219/627 |
| 5,412,171 | A | 5/1995 | Yahav et al. | |
| 7,355,150 | B2 * | 4/2008 | Baarman et al. | 219/620 |
| 2004/0149736 | A1 * | 8/2004 | Clothier | 219/627 |
| 2006/0263501 | A1 | 11/2006 | Oghafua et al. | |
| 2007/0187396 | A1 * | 8/2007 | Kim | 219/702 |

FOREIGN PATENT DOCUMENTS

| | | | |
|---|---|---|---|
| CN | 2819701 | Y | 9/2006 |
| TW | 200518637 | | 6/2005 |
| TW | 200806929 | A | 2/2008 |
| TW | 328675 | | 3/2008 |
| WO | WO 2008/037355 | A1 * | 4/2008 |

* cited by examiner

*Primary Examiner* — Tu Hoang
*Assistant Examiner* — Hung D Nguyen
(74) *Attorney, Agent, or Firm* — Kirton McConkie; Evan R. Witt

(57) ABSTRACT

An intelligent heater includes a first induction coil, a control panel, a power supply unit, a storage unit, a data transmission interface, and a controlling unit. The control panel includes an input unit for inputting, adding, amending, deleting or refreshing a cooking data and a display unit for showing an operating condition of the intelligent heater. The power supply unit is connected with the first induction coil for providing a first power to the first induction coil. The storage unit is used for storing the cooking data. The data transmission interface is used for transmitting the cooking data. The controlling unit is used for controlling the power supply unit to provide an electricity quantity of the first power to the first induction coil according to the cooking data, so that a heat quantity and a heating time required for heating a first foodstuff container are adaptively adjusted.

11 Claims, 4 Drawing Sheets

INTELLIGENT HEATER AND TEMPERATURE MEASURING DEVICE

FIELD OF THE INVENTION

The present invention relates to a heater, and more particularly to an intelligent heater. The present invention also relates to a temperature measuring device for use with the intelligent heater.

BACKGROUND OF THE INVENTION

Nowadays, a variety of cooking utensils such as gas stoves, infrared oven, microwave oven and electric stove are widely used to cook food. Different cooking utensils have their advantages or disadvantages. Depending on the food to be cooked, a desired cooking utensil is selected.

Take an induction cooking stove for example. When a current flows through the induction coil of the induction cooking stove, electromagnetic induction is performed to produce eddy current, thereby heating a foodstuff container. By adjusting the electricity quantity to the induction coil, the heat quantity supplied to the induction coil is controllable. As known, depending on the kinds and ingredients of the foodstuffs, the heat quantity and the heating time required for heating different foodstuff containers are usually different. By undue experiments, the user may realize optimal cooking data associated with different foodstuffs. The cooking data include the heat quantity and the heating time required for heating the foodstuff container and a sequence of placing ingredients of a foodstuff into the foodstuff container. If the user forgets the cooking data, the user may fail to cook a delicious food.

Furthermore, the conventional induction cooking stove has a function of measuring a temperature of the foodstuff container. Since the temperature of the foodstuff contained in the foodstuff container fails to be measured, the heat quantity and the heating time required for heating the foodstuff container are empirically determined. For achieving the optimal cooking data, the user may place a thermometer into the foodstuff container to be in contact with the foodstuff in order to measure the foodstuff temperature. According to the foodstuff temperature, the heat quantity and the heating time required for heating the foodstuff container could be determined more reliably. As known, some kinds of foodstuffs need to be cooked at a specified temperature in order to produce delicacy taste. In other words, the actual foodstuff temperature is an important factor for cooking such foodstuffs. Even if a thermometer is used to measure the foodstuff temperature, the user needs to continuously adjust the heat quantity for heating the foodstuff container. A too long or too short heating time fails to produce the delicacy taste.

There is a need of providing an intelligent heater so as to obviate the drawbacks encountered from the prior art.

SUMMARY OF THE INVENTION

It is an object of the present invention to provide an intelligent heater for adaptively adjusting the heat quantity and the heating time according to different foodstuffs or foods.

Another object of the present invention provides an intelligent heater for sharing cooking data with an external electronic device.

A further object of the present invention provides temperature measuring device for use with an intelligent heater to measure a foodstuff temperature, so that the foodstuff temperature could be transmitted to the intelligent heater in real time.

In accordance with an aspect of the present invention, there is provided an intelligent heater for heating a first foodstuff container. The intelligent heater includes a first induction coil, a control panel, a power supply unit, a storage unit, a data transmission interface, and a controlling unit. The control panel includes an input unit for inputting, adding, amending, deleting or refreshing a cooking data and a display unit for showing an operating condition of the intelligent heater. The power supply unit is connected with the first induction coil for providing a first power to the first induction coil. The storage unit is used for storing the cooking data. The data transmission interface is used for transmitting the cooking data. The controlling unit is connected to the control panel, the power supply unit, the storage unit and the data transmission interface for controlling the power supply unit to provide an electricity quantity of the first power to the first induction coil according to the cooking data, so that a heat quantity and a heating time required for heating the first foodstuff container are adaptively adjusted.

In accordance with another aspect of the present invention, there is provided a temperature measuring device for use with an intelligent heater. The temperature measuring device includes a temperature detecting unit, a signal processing unit, and a temperature data transmission interface. The temperature detecting unit is used for issuing a temperature signal according to a temperature change. The signal processing unit is connected to the temperature detecting unit for controlling operations of the temperature measuring device. According to the temperature signal, the signal processing unit issues a temperature data. The temperature data is transmitted to the intelligent heater through the temperature data transmission interface in real time.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
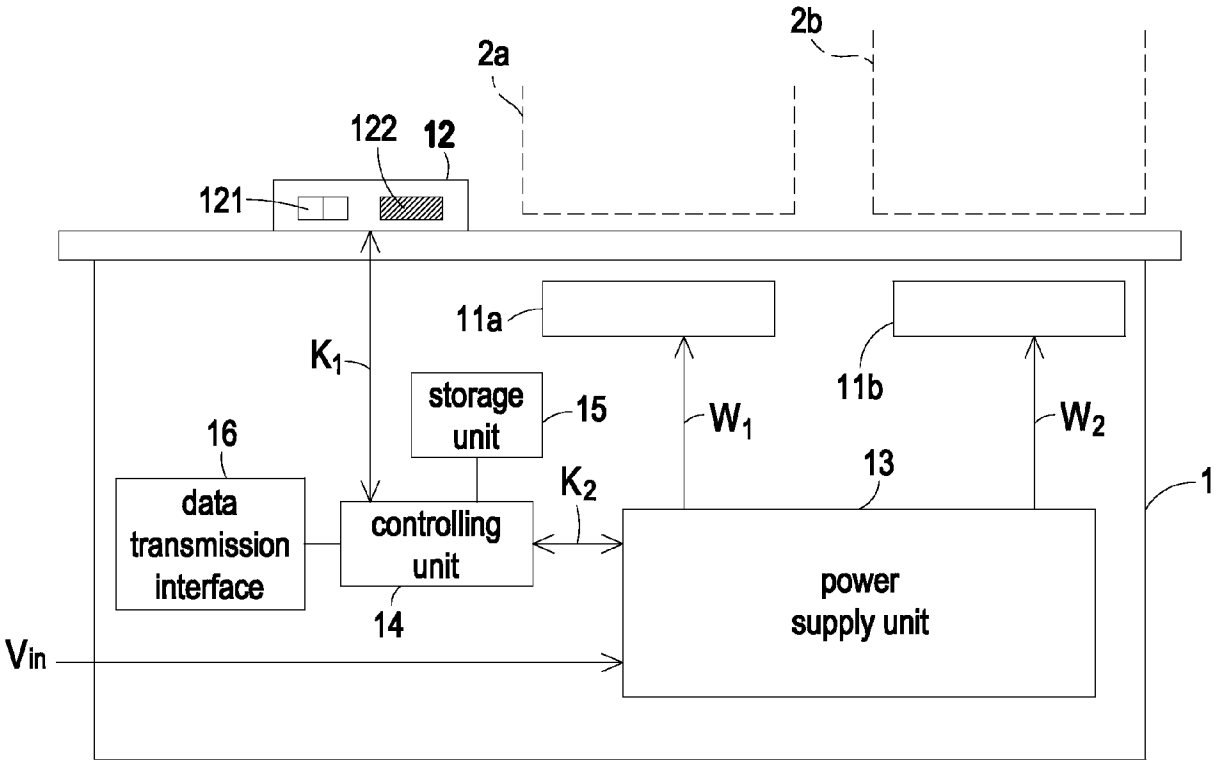
FIG. 1 is a schematic functional block diagram illustrating an intelligent heater according to an embodiment of the present invention.

FIG. 1 is a schematic functional block diagram illustrating an intelligent heater according to an embodiment of the present invention. As shown in FIG. 1, the intelligent heater 1 comprises a first induction coil 11*a*, a second induction coil 11*b*, a control panel 12, a power supply unit 13, a controlling unit 14, a storage unit 15, and a data transmission interface 16. When a current flows through the first induction coil 11*a* and the second induction coil 11*b*, electromagnetic induction is performed to produce eddy current, thereby respectively heating a first foodstuff container 2*a* and a second foodstuff container 2*b*. The first induction coil 11*a* and the second induction coil 11*b* are connected to a first power output terminal and a second power output terminal of the power supply unit 13, respectively.

The control panel 12 is disposed on the outer surface of the intelligent heater 1 and connected to the controlling unit 14. The control panel 12 comprises an input unit 121 and a display unit 122. Via the input unit 121, the user could input the cooking data. The display unit 122 is used for displaying the operating condition of the intelligent heater 1. The power supply unit 13 is connected to the first induction coil 11*a*, the second induction coil 11*b* and the controlling unit 14 for providing a first power $W_1$ and a second power $W_2$ to the first induction coil 11*a* and the second induction coil 11*b*, respectively. As such, the first foodstuff container 2*a* and the second foodstuff container 2*b* are respectively heated by the first induction coil 11*a* and the second induction coil 11*b*. The controlling unit 14 is connected to the control panel 12, the power supply unit 13, the storage unit 15 and the data transmission interface 16. According to the cooking data stored in the storage unit 15, the voltage values or the frequency values of the first power $W_1$ and the second power $W_2$ are controlled by the controlling unit 14. As a consequence, the intelligent heater 1 could automatically adjust the heat quantity and the heating time required for heating the first foodstuff container 2*a* and the second foodstuff container 2*b*. The data transmission interface 16 is connected to the controlling unit 14. Via the controlling unit 14, the intelligent heater 1 and the external electronic device (not shown) exchange data between each other.

The storage unit 15 of the intelligent heater 1 is used for storing cooking data, for example the heat quantity and the heating time required for heating various foodstuff containers with respect to different foodstuffs or foods. For cooking foodstuffs or foods, the user could select a desired cooking item through the input unit 121 of the control panel 12. After the desired cooking item is selected, the voltage values or the frequency values of the first power $W_1$ and the second power $W_2$ that are provided by the power supply unit 13 are controlled according to the cooking data under control of the controlling unit 14. In other words, according to the cooking data, the intelligent heater 1 will automatically adjust the heat quantity and the heating time required for heating the first foodstuff container 2*a* and the second foodstuff container 2*b*.

By operating the control panel 12, a first signal $K_1$ is transmitted to the controlling unit 14. According to the first signal $K_1$, the controlling unit 14 issues a second signal $K_2$ to the power supply unit 13. In a case that the user input a data through the input unit 121 of the control panel 12, the status of the first signal $K_1$ is changed and thus the input data is transmitted to the controlling unit 14. Furthermore, by changing the status of the first signal $K_1$, the display data could be transmitted to the display unit 122 of the control panel 12, so that the operating condition of the intelligent heater 1 is shown on the display unit 122. By changing the status of the second signal $K_2$, the controlling unit 14 could control the voltage values or the frequency values of the first power $W_1$ and the second power $W_2$. As such, since the electricity quantity provided by the power supply unit 13 to the first induction coil 11*a* and the second induction coil 11*b* is controlled, the intelligent heater 1 will automatically adjust the heat quantity and the heating time required for heating the first foodstuff container 2*a* and the second foodstuff container 2*b*. Furthermore, according to status of the second signal $K_2$, the controlling unit 14 could realize the operating data of the power supply unit 13 (e.g. the voltage values or the frequency values of the first power W1 and the second power W2).

An example of the controlling unit 14 of the intelligent heater 1 includes but is not limited to a pulse frequency modulation (PFM) controller or a digital signal processor (DSP). In an embodiment, the power supply unit 13 is an AC-to-AC converting circuit. The voltage and frequency of an input AC voltage $V_{in}$ (i.e. input power) is subject to conversion by the power supply unit 13, so that the power supply unit 13 provides the first power $W_1$ and the second power W2 to the first induction coil 11*a* and the second induction coil 11*b*, respectively. Since the electricity quantity inputted into the first induction coil 11*a* is in reverse proportion to a first frequency $f_1$ of the first power $W_1$ and the electricity quantity inputted into the second induction coil 11*b* is in reverse proportion to a second frequency $f_2$ of the second power $W_2$, the electricity quantity outputted from the power supply unit 13 to the first induction coil 11*a* and the second induction coil 11*b* could be adjusted by controlling the voltage values or the frequency values of the first power $W_1$ and the second power $W_2$. Accordingly, the heat quantity to be outputted from the first induction coil 11*a* and the second induction coil 11*b* to the first foodstuff container 2*a* and the second foodstuff container 2*b* is adjustable.

In this embodiment, the input unit 121 of the intelligent heater 1 is for example a button-type operating element or a rotary operating element. The display unit 122 of the intelligent heater 1 is for example a liquid crystal display (LCD) or an indicator lamp. In some embodiments, the input unit 121 and the display unit 122 are integrated into a touch panel. In this embodiment, the first induction coil 11*a* and the second induction coil 11*b* of the intelligent heater 1 are used to heat the first foodstuff container 2*a* and the second foodstuff container 2*b*, respectively. In some embodiments, the first induction coil 11*a* and the second induction coil 11*b* are used to simultaneously heat a single larger foodstuff container (not shown). Hereinafter, the first foodstuff container 2*a* and the second foodstuff container 2*b* respectively heated by the first induction coil 11*a* and the second induction coil 11*b* will be illustrated in more details.

Figure 2:
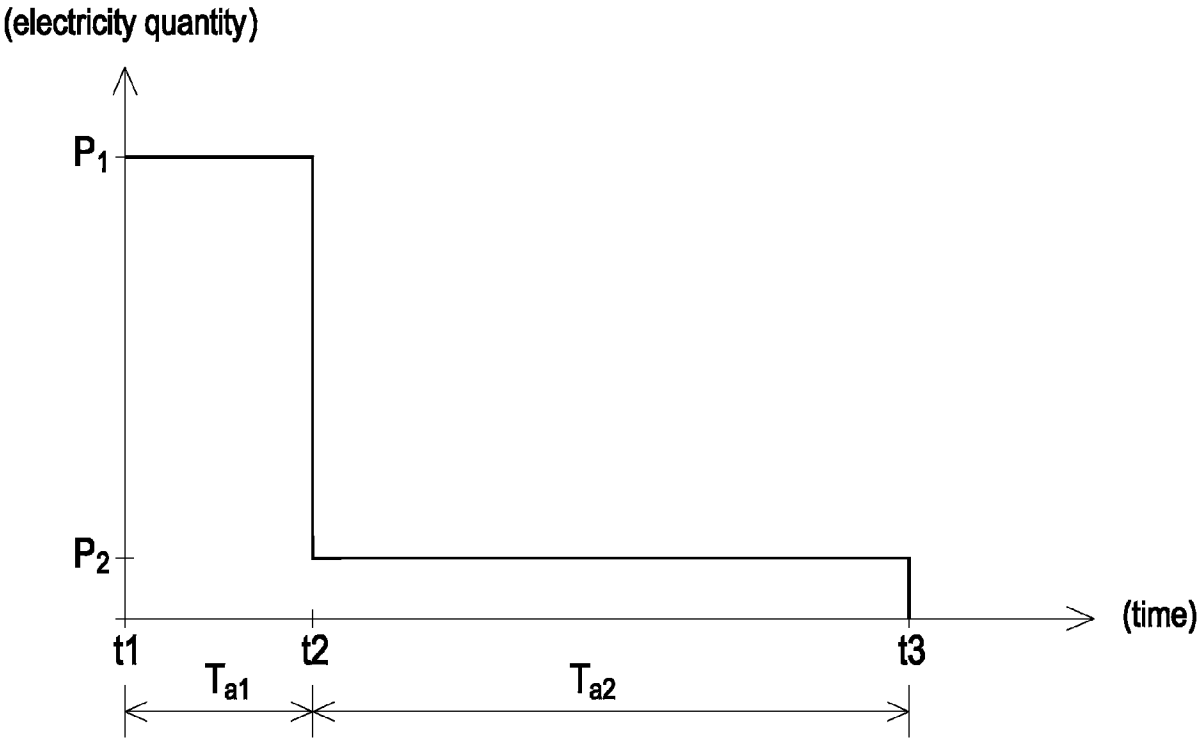
FIG. 2 is a timing waveform diagram schematically illustrating the relationship between the heating time and the electricity quantity provided to the first induction coil according to a first implementing example of the present invention.

FIG. 2 is a timing waveform diagram schematically illustrating the relationship between the heating time and the electricity quantity provided to the first induction coil according to a first implementing example of the present invention. In this embodiment, the foodstuff to be cooked includes 300 grams of adzuki beans and appropriate amount of water. At the first time spot $t_1$, a desired cooking item (i.e. 300 grams of adzuki beans) is selected via the input unit 121 of the control panel 12. Meanwhile, the controlling unit 14 controls the power supply unit 13 to provide a first electricity quantity $P_1$ to the first induction coil 11*a* according to the cooking item. Corresponding to the first electricity quantity $P_1$, the first induction coil 11*a* provides a first heat quantity to heat the first foodstuff container 2*a*. After the first foodstuff container 2*a* has been heated with the first electricity quantity $P_1$ for a first time interval $T_{a1}$, the water contained in the first foodstuff container 2*a* is boiled to 100° C. (at the second time spot $t_2$). Meanwhile, the controlling unit 14 controls the power supply unit 13 to provide a second electricity quantity $P_2$ to the first induction coil 11*a* according to the cooking item. Corresponding to the second electricity quantity $P_2$, the first induction coil 11*a* provides a second heat quantity to heat the first foodstuff container 2*a*. After the first foodstuff container 2*a* has been heated with the second electricity quantity $P_2$ for a second time interval $T_{a2}$, the cooking process is finished (at the third time spot $t_3$). Meanwhile, the controlling unit 14 controls the power supply unit 13 to stop providing electricity to the first induction coil 11*a*.

In this embodiment, the ingredients of the foodstuff (i.e. 300 grams of adzuki beans and appropriate amount of water) are placed in the first foodstuff container 2*a* before the first time spot $t_1$. During the automatic cooking process, the controlling unit 14 could control the heat quantity and the heating time for heating the first foodstuff container 2*a*.

In a case that the thermal properties of different ingredients of the foodstuff are considerably different, some ingredients are suitably placed in the foodstuff container before the first time spot $t_1$ but some other ingredients are suitably placed in the foodstuff container during the cooking process.

Figure 3:
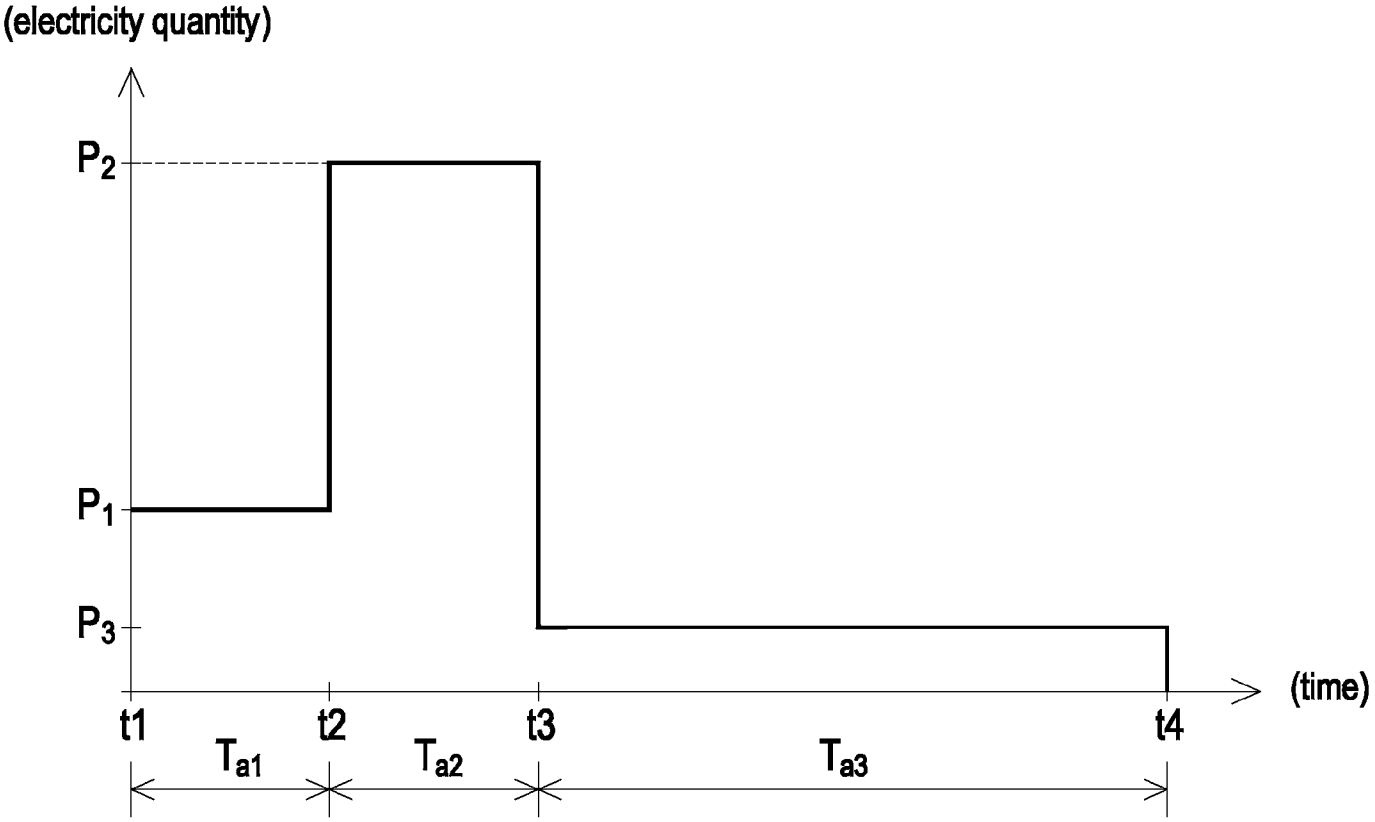
FIG. 3 is a timing waveform diagram schematically illustrating the relationship between the heating time and the electricity quantity provided to the first induction coil according to a second implementing example of the present invention.

FIG. 3 is a timing waveform diagram schematically illustrating the relationship between the heating time and the electricity quantity provided to the first induction coil according to a second implementing example of the present invention. In this embodiment, the foodstuff to be cooked includes 600 grams of pork and appropriate amount of seasoning (e.g. green onion or garlic). At the first time spot $t_1$, a desired cooking item (i.e. 600 grams of pork) is selected via the input unit 121 of the control panel 12. Meanwhile, the controlling unit 14 controls the display unit 122 of the control panel 12 to indicate a first prompt message "please place a first ingredient of the foodstuff" according to the cooking item. After the first ingredient of the foodstuff (e.g. green onion or garlic) is placed in the first foodstuff container 2*a*, the intelligent heater 1 is activated by the user via the input unit 121 of the control panel 12 (at the first time spot $t_1$). The controlling unit 14 controls the power supply unit 13 to provide a first electricity quantity $P_1$ to the first induction coil 11*a*. Corresponding to the first electricity quantity $P_1$, the first induction coil 11*a* provides a first heat quantity to heat the first foodstuff container 2*a*.

After the first foodstuff container 2*a* has been heated with the first electricity quantity $P_1$ for a first time interval $T_{a1}$, the controlling unit 14 controls the display unit 122 of the control panel 12 to indicate a second prompt message "please place a second ingredient of the foodstuff" according to the cooking item (at the second time spot $t_2$). After the second ingredient of the foodstuff (e.g. 600 grams of pork and water) is placed in the first foodstuff container 2*a*, the controlling unit 14 controls the power supply unit 13 to provide a second electricity quantity $P_2$ to the first induction coil 11*a*. Corresponding to the second electricity quantity $P_2$, the first induction coil 11*a* provides a second heat quantity to heat the first foodstuff container 2*a*.

After the first foodstuff container 2*a* has been heated with the second heat quantity for a second time interval $T_{a2}$, the water contained in the first foodstuff container 2*a* is boiled to 100° C. (at the third time spot $t_3$). Meanwhile, the controlling unit 14 controls the power supply unit 13 to provide a third electricity quantity $P_3$ to the first induction coil 11*a* according to the cooking item. Corresponding to the third electricity quantity $P_3$, the first induction coil 11*a* provides a third heat quantity to heat the first foodstuff container 2*a*. After the first foodstuff container 2*a* has been heated with the third electricity quantity $P_3$ for a third time interval $T_{a3}$, the cooking process is finished (at the fourth time spot $t_4$). Meanwhile, the controlling unit 14 controls the power supply unit 13 to stop providing electricity to the first induction coil 11*a*.

From the above description, the cooking data are classified according to the cooking item. The cooking data usually include the heat quantity required for performing the cooking process, the heating time, the sequence of placing the ingredients of the foodstuff into the foodstuff container, or the like. According to the selected cooking item, the controlling unit 14 will adaptively adjust the heat quantity and the heating time. In a case that a cooking item related to the foodstuff or food to be cooked is not included in the cooking data which are stored in the storage unit 15, the user may add the heat quantity and the heating time related to the foodstuff or food via the data transmission interface 16. Alternatively, the automatic cooking function may be disabled. In other words, the user may manually adjust the heat quantity and the heating time of the first induction coil 11*a* and/or the second induction coil 11*b*.

During the manual cooking process, the cooking item related to the foodstuff or food to be cooked and the heat quantity and the heating time corresponding to the cooking item will be automatically recorded into the cooking data. In some embodiments, the new cooking item could be inputted via the input unit 121 of the control panel 12, and the heat quantity and the heating time corresponding to the cooking item could be automatically stored in the storage unit 15 under control of the controlling unit 14. In an automatic recording mode of the intelligent heater 1, the user needs to carefully adjust the heat quantity by continuously monitoring the change of the foodstuff. Whereas, in the manual cooking mode of the intelligent heater 1, the controlling unit 14 will automatically record the heating time corresponding to the cooking item into the cooking data. Moreover, via the input unit 121 of the control panel 12, the user could edit, amend or add the contents of the cooking data, so that the heat quantity and the heating time become more feasible.

In this embodiment, the data transmission interface 16 is a bidirectional transmission interface. Through the data transmission interface 16, the added or amended cooking item included in the cooking data could be shared with an external electronic device. For example, the cooking data stored in the storage unit 15 could be directly transmitted from this intelligent heater 1 to the storage unit of another intelligent heater through the data transmission interface 16. Alternatively, the cooking data stored in the storage unit 15 could be transmitted from this intelligent heater 1 to a portable storage device such as a portable hard disk, a USB disk or a SD memory card. An example of the data transmission interface 16 includes but is not limited to a USB (universal serial bus) interface, a Bluetooth interface or an Ethernet interface.

From the above discussion, it is found that the contents of the cooking data could be added, amended, deleted or refreshed via the data transmission interface 16 as well as the input unit 121 of the control panel 12.

Figure 4:
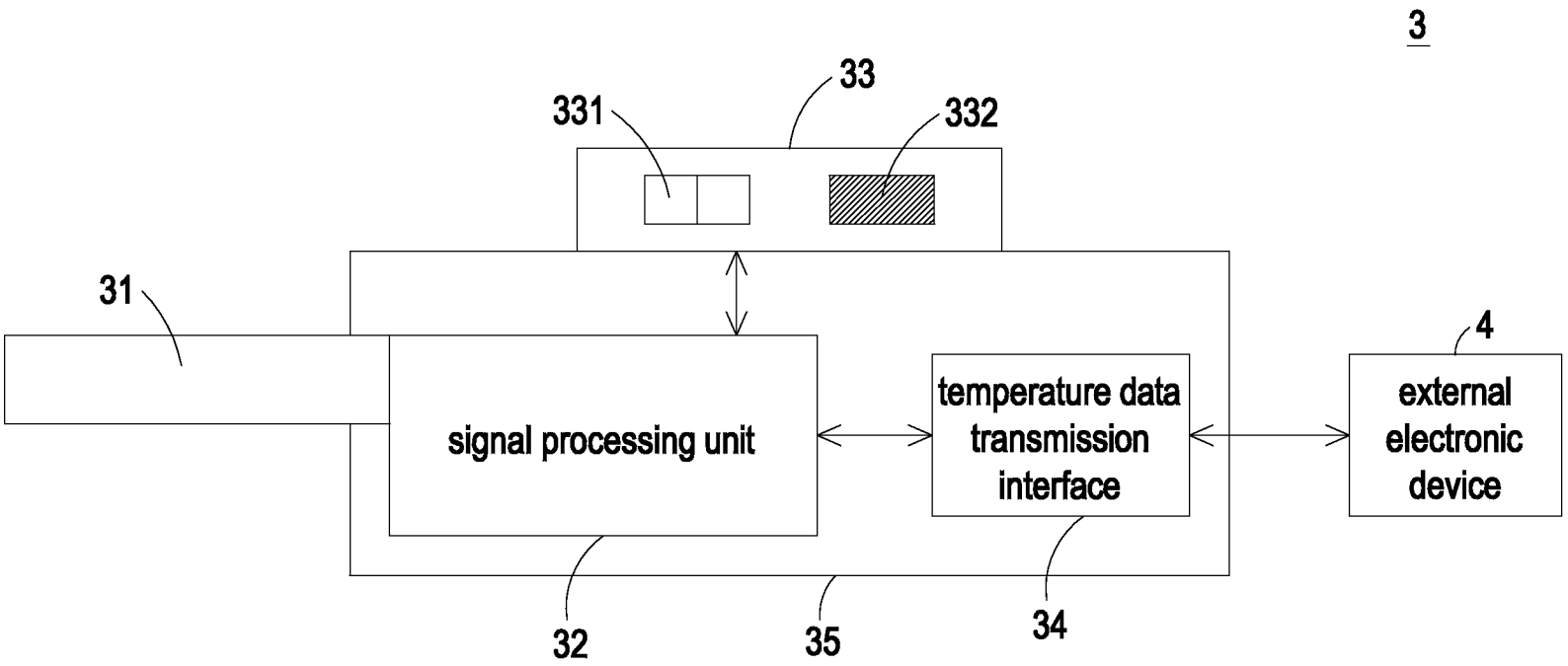
FIG. 4 is a schematic functional block diagram illustrating a temperature measuring device according to an embodiment of the present invention.

FIG. 4 is a schematic functional block diagram illustrating a temperature measuring device according to an embodiment of the present invention. As shown in FIG. 4, the temperature measuring device 3 comprises a temperature detecting unit 31, a signal processing unit 32, a control panel 33 and a temperature data transmission interface 34. The temperature detecting unit 31 is connected to the signal processing unit 32, and exposed outside the casing 35. According to a temperature change, the temperature detecting unit 31 issues a corresponding temperature signal to the signal processing unit 32. The signal processing unit 32 is disposed within the casing 35, and connected to the temperature detecting unit 31, the control panel 33 and the temperature data transmission interface 34. The signal processing unit 32 is used for controlling operations of the temperature measuring device 3. The control panel 33 is disposed on the outer surface of the temperature measuring device 3, and comprises an input unit 331 and a display unit 332. Via the input unit 331, the user could input the control instruction. The temperature data measured by the temperature measuring device 3 is shown on the display unit 332. In this embodiment, the input unit 331 is for example a button-type operating element or a rotary operating element. The display unit 332 of the temperature measuring device 3 is for example a liquid crystal display (LCD) or an indicator lamp. In some embodiments, the input unit 331 and the display unit 332 are integrated into a touch panel.

After the temperature measuring device 3 is activated by triggering the input unit 331 of the control panel 33, the temperature detecting unit 31 issues a temperature signal to the signal processing unit 32. By calculating the temperature signal, the signal processing unit 32 generates a corresponding temperature data. The temperature data could be directly shown on the display unit 332 of the control panel 33. Furthermore, the temperature data could be transmitted to an external electronic device 4 through the temperature data transmission interface 34. An example of the external electronic device 4 is the intelligent heater 1 of the present invention. An example of the temperature data transmission interface 34 includes but is not limited to a USB (universal serial bus) interface, a Bluetooth interface or an Ethernet interface.

The temperature data could be transmitted to an external electronic device 4 through the temperature data transmission interface 34 in a wired or wireless transmission manner. For example, in a case that the temperature data transmission interface 34 is a USB interface, the temperature data transmission interface 34 is connected with the external electronic device 4 through a transmission wire (not shown), so that the measured temperature data could be transmitted from the temperature data transmission interface 34 to the external electronic device 4 in real time. When the temperature measuring device 3 is applied to the intelligent device 1 of the present invention, the temperature measuring device is in direct contact with the foodstuff that is placed in the first foodstuff container 2*a* or the second foodstuff container 2*b* in order to actually measure the foodstuff temperature. Moreover, when the foodstuff in the first foodstuff container 2*a* or the second foodstuff container 2*b* is be stirred by the temperature measuring device 3, the temperature data associated with the foodstuff could be transmitted to the controlling unit 14 of the intelligent heater 1 through the temperature data transmission interface 34 of the temperature measuring device 3 and the data transmission interface 16 of the intelligent heater 1. Therefore, the intelligent heater of the present invention could actually measure the foodstuff temperature and adaptively adjust the heat quantity and the heating time of for heating the first foodstuff container or the second foodstuff container according to different foodstuffs and foods.

From the above description, the intelligent heater of the present invention could adaptively adjust the heat quantity and the heating time for heating the first foodstuff container or the second foodstuff container according to different foodstuffs and foods. In an automatic recording mode of the intelligent heater, the user could carefully adjust the heat quantity by continuously monitoring the change of the foodstuff. In the manual cooking mode of the intelligent heater, the controlling unit will automatically record the heating time corresponding to the cooking item into the cooking data. The contents of the cooking data could be added, amended, deleted or refreshed via the data transmission interface as well as the input unit of the control panel. Moreover, through the data transmission interface, the added or amended cooking item included in the cook data could be shared with an external electronic device.

The temperature measuring device of the present invention is capable of measuring temperature and transmitting the temperature data to an external electronic device (e.g. the intelligent heater of the present invention). When the temperature measuring device is applied to the intelligent heater, the temperature measuring device is contacted with the foodstuff that is placed in the first foodstuff container or the second foodstuff container, so that the temperature data associated with the foodstuff could be transmitted to the intelligent heater in real time. According to the temperature data, the intelligent heater could adaptively adjust the heat quantity and the heating time required for heating the first foodstuff container or the second foodstuff container.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An intelligent heater for heating a first foodstuff container, said intelligent heater comprising:

a first induction coil;

a control panel comprising an input unit for inputting, adding, amending, deleting or refreshing a cooking data and a display unit for showing an operating condition of said intelligent heater;

a power supply unit connected with said first induction coil for providing a first power to said first induction coil;

a storage unit for storing said cooking data;

a data transmission interface for transmitting said cooking data, wherein said cooking data of said intelligent heater is transmitted from said intelligent heater to another intelligent heater through said data transmission interface, said cooking data of another intelligent heater is transmitted from said another intelligent heater to said storage unit of said intelligent heater through said data transmission interface, so that said cooking data which is added, amended, deleted or refreshed in said intelligent heater or said another intelligent heater is shared between said intelligent heater and said another intelligent heater via said data transmission interface, and said data transmission interface is an USB interface; and a controlling unit connected to said control panel, said power supply unit, said storage unit and said data transmission interface for controlling said power supply unit to provide an electricity quantity of said first power to said first induction coil according to said cooking data, so that a heat quantity and a heating time required for heating said first foodstuff container are adaptively adjusted.

2. The intelligent heater according to claim 1 wherein said cooking data is classified according to a cooking item, and said cooking data includes said heat quantity and said heating time required for heating said first foodstuff container and a sequence of placing ingredients of a foodstuff into said first foodstuff container.

3. The intelligent heater according to claim 1 wherein during a cooking process, said heat quantity and said heating time corresponding to a foodstuff is selectively recorded into said cooking data.

4. The intelligent heater according to claim 1 wherein said electricity quantity outputted from said power supply unit to said first induction coil is adjusted by controlling voltage values or frequency values of said first power by said controlling unit.

5. The intelligent heater according to claim 1 wherein said controlling unit is a pulse frequency modulation controller or a digital signal processor.

6. The intelligent heater according to claim 1 wherein a voltage and a frequency of an input power is subject to conversion by said power supply unit, so that said power supply unit generates and provides said first power to said first induction coil.

7. The intelligent heater according to claim 1 wherein said input unit of said intelligent heater is a button-type operating element or a rotary operating element.

8. The intelligent heater according to claim 1 wherein said display unit of said intelligent heater is a liquid crystal display or an indicator lamp.

9. The intelligent heater according to claim 1 further comprising temperature measuring device in direct contact with a foodstuff of said first foodstuff container for measuring a foodstuff temperature of said foodstuff, wherein said foodstuff temperature is transmitted to said controlling unit through said data transmission interface.

10. The intelligent heater according to claim 1 further comprising a second induction coil connected to said power supply unit, wherein said power supply unit provides a second power to said second induction coil, thereby heating said first foodstuff container or a second foodstuff container.

11. An intelligent heater for heating a first foodstuff container, said intelligent heater comprising:

a first induction coil;

a control panel comprising an input unit for inputting, adding, amending, deleting or refreshing a cooking data and a display unit for showing an operating condition of said intelligent heater;

a power supply unit connected with said first induction coil for providing a first power to said first induction coil;

a storage unit for storing said cooking data;

a data transmission interface for transmitting said cooking data, wherein said cooking data of said intelligent heater is transmitted from said intelligent heater to another intelligent heater through said data transmission interface, said cooking data of another intelligent heater is transmitted from said another intelligent heater to said storage unit of said intelligent heater through said data transmission interface, so that said cooking data which is added, amended, deleted or refreshed in said intelligent heater or said another intelligent heater is shared between said intelligent heater and said another intelligent heater via said data transmission interface, and said data transmission interface is a Bluetooth interface or an Ethernet interface; and a controlling unit connected to said control panel, said power supply unit, said storage unit and said data transmission interface for controlling said power supply unit to provide an electricity quantity of said first power to said first induction coil according to said cooking data, so that a heat quantity and a heating time required for heating said first foodstuff container are adaptively adjusted.

* * * * *